US010982856B2

(12) United States Patent
Oskooei et al.

(10) Patent No.: US 10,982,856 B2
(45) Date of Patent: Apr. 20, 2021

(54) FUEL NOZZLE WITH SLEEVES FOR THERMAL PROTECTION

(71) Applicant: PRATT & WHITNEY CANADA CORP., Longueuil (CA)

(72) Inventors: Saeid Oskooei, North York (CA); Gavin Rohiteswar Kisun, Mississauga (CA); Nadia Cheri Swaby, York (CA); Roger Neil Antony Francis, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 180 days.

(21) Appl. No.: 16/264,946

(22) Filed: Feb. 1, 2019

(65) Prior Publication Data

US 2020/0248904 A1 Aug. 6, 2020

(51) Int. Cl.
*F23R 3/00* (2006.01)
*F23R 3/28* (2006.01)

(52) U.S. Cl.
CPC .... *F23R 3/283* (2013.01); *F23R 2900/00004* (2013.01)

(58) Field of Classification Search
CPC ..... F23R 3/283; F23R 2900/00004
See application file for complete search history.

(56) References Cited

U.S. PATENT DOCUMENTS 4,070,826 A 1/1978 Stenger et al.
5,009,070 A 4/1991 Iizuka et al.
5,761,907 A 6/1998 Pelletier et al.
6,141,968 A 11/2000 Gates et al.
6,256,995 B1 * 7/2001 Sampath ..... F23D 11/36 60/740
6,276,141 B1 8/2001 Pelletier
6,547,163 B1 4/2003 Mansour et al.
7,415,828 B2 8/2008 Brown
7,832,377 B2 11/2010 Lee et al.
8,015,815 B2 9/2011 Pelletier et al.
8,074,452 B2 12/2011 Prociw et al.
8,156,746 B2 4/2012 Buelow et al.
8,196,845 B2 6/2012 Thomson et al.
8,205,643 B2 * 6/2012 Lee ..... F16L 9/19 138/114
8,240,151 B2 8/2012 Pelletier et al.
8,695,349 B2 4/2014 Toon
9,133,767 B2 9/2015 Woerz et al.
9,383,107 B2 7/2016 Shershnyov et al.
9,400,104 B2 7/2016 Low et al.
(Continued)

*Primary Examiner* — Katheryn A Malatek

(74) *Attorney, Agent, or Firm* — Norton Rose Fulbright Canada LLP

(57) ABSTRACT

A fuel nozzle for injecting fuel and air into a combustor of a gas turbine engine, the fuel nozzle comprising: an outer component having an outward surface adapted for exposure to a flow of hot gas within the combustor, and an inward surface; an inner component concentrically disposed within the inward surface of outer component along a nozzle axis, the inner component defining an axially extending air flow channel; an air passage bore extending through the outward surface of the outer component and communicating with the air flow channel; and a thermal insulating sleeve disposed within the air passage bore, the sleeve having a sleeve body spaced apart from the outer component by an air gap.

19 Claims, 4 Drawing Sheets

(56) References Cited

U.S. PATENT DOCUMENTS

| | | | | |
|---|---|---|---|---|
| 9,920,693 | B2 | 3/2018 | Hanson | |
| 10,001,281 | B2 | 6/2018 | Patel et al. | |
| 10,125,991 | B2 | 11/2018 | Ramier et al. | |
| 2010/0251723 | A1* | 10/2010 | Chen | F23R 3/045 60/760 |
| 2011/0314826 | A1* | 12/2011 | Jordan | F23R 3/283 60/740 |
| 2012/0304648 | A1* | 12/2012 | Byrne | F23R 3/283 60/737 |
| 2013/0031908 | A1* | 2/2013 | DiCintio | F23R 3/346 60/752 |
| 2014/0339339 | A1 | 11/2014 | Prociw | |
| 2015/0285502 | A1 | 10/2015 | DiCintio et al. | |
| 2016/0047315 | A1 | 2/2016 | McCaldon et al. | |
| 2016/0273453 | A1 | 9/2016 | Frish et al. | |
| 2017/0122564 | A1 | 5/2017 | Cadman et al. | |
| 2017/0268786 | A1 | 9/2017 | Cai et al. | |

* cited by examiner

FUEL NOZZLE WITH SLEEVES FOR THERMAL PROTECTION

TECHNICAL FIELD

The disclosure relates generally to gas turbine engines, and more particularly, to fuel nozzle insulation.

BACKGROUND

Fuel nozzles for gas turbine engines are supplied with fluid fuel under pressure and compressed air. The fuel and air are conveyed axially and radially through flow channels within the fuel nozzle to spray, swirl, atomize and mix together on exit in preparation for fuel ignition and combustion.

The flow channels within fuel nozzles are defined between inward and outward surfaces of various concentric components that are brazed or welded together. Flow channels can also be machined into a component. The outermost component of the concentric assembly of components is exposed to hot combustion gas flowing within the combustion chamber and around exterior surfaces of the fuel nozzle.

Air flow bores communicate with the air flow channels to convey compressed air radially inward from the outward flow channels to the outer surface of the innermost component of the fuel nozzle that is exposed to hot gases. The outer surface of the outermost component of the fuel nozzle can absorb heat from the surrounding hot gases. Via convection and conduction, the outer surface of the outermost component can convey heat to the inner concentric components of the fuel nozzle.

Although the temperature of the inner concentric components during operation is moderated by the continuous flow of cooler fuel through the flow channels in the fuel nozzle, avoiding heat transfer by convection and conduction from hot air is desirable to reduce thermal stress, extend the service life of the components, and reduce or eliminate coke build up in fuel passage. Improvement is thus desirable.

SUMMARY

In one aspect, the disclosure describes a fuel nozzle for injecting fuel and air into a combustor of a gas turbine engine, the fuel nozzle comprising: an outer component having an outward surface adapted for exposure to a flow of hot gas within the combustor; an inner component concentrically disposed within the outer component, the inner component defining an axially extending air flow channel; an air passage bore extending from the outward surface of the outer component to the air flow channel; and a sleeve disposed at least within a portion of the air passage bore, the sleeve having a sleeve body spaced apart from the outer component by an air gap.

In another aspect, the disclosure describes a gas turbine engine with a fuel nozzle as described above. Embodiments can include combinations of the above features.

Further details of these and other aspects of the subject matter of this application will be apparent from the detailed description included below and the drawings.

DETAILED DESCRIPTION

Figure 1:
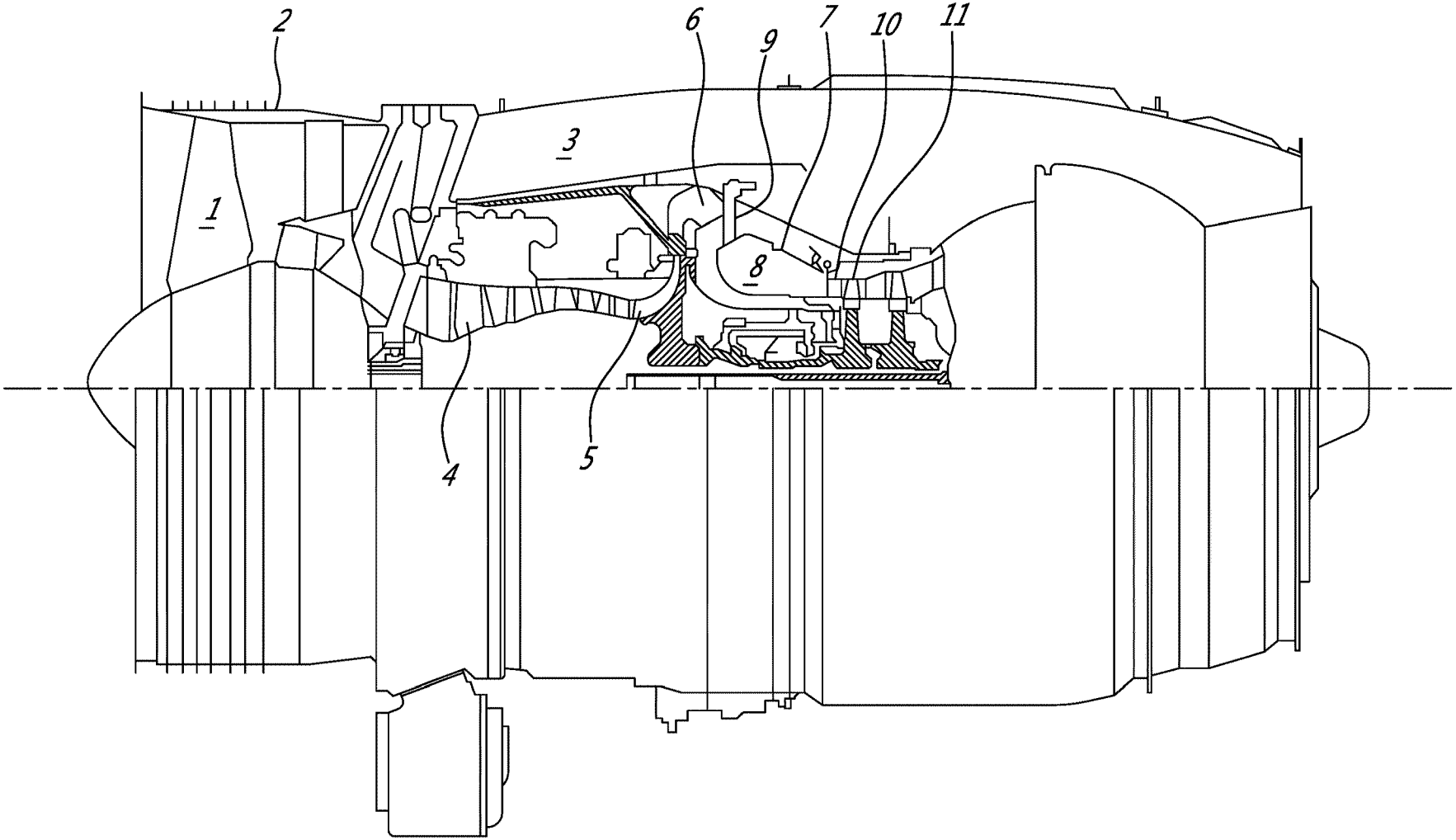
FIG. 1 shows an axial cross-section view of a turbofan gas turbine engine.

FIG. 1 shows an axial cross-section through an example prior art turbo-fan gas turbine engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 and fuel is mixed with compressed air from the plenum 7 when sprayed through fuel nozzles (not shown in FIG. 1, see FIGS. 2-4) into the combustor 8 to create a fuel air mixture that is ignited and burned in the combustor 8. A portion of the compressed air within the plenum 7 is admitted into the combustor 8 through orifices in the side walls to create a cooling air curtain along the combustor walls or is used for cooling to eventually mix with the hot gases from the combustor 8 and pass over the nozzle guide vane 10 and turbines 11 before exiting the tail of the engine as exhaust.

Figure 2:
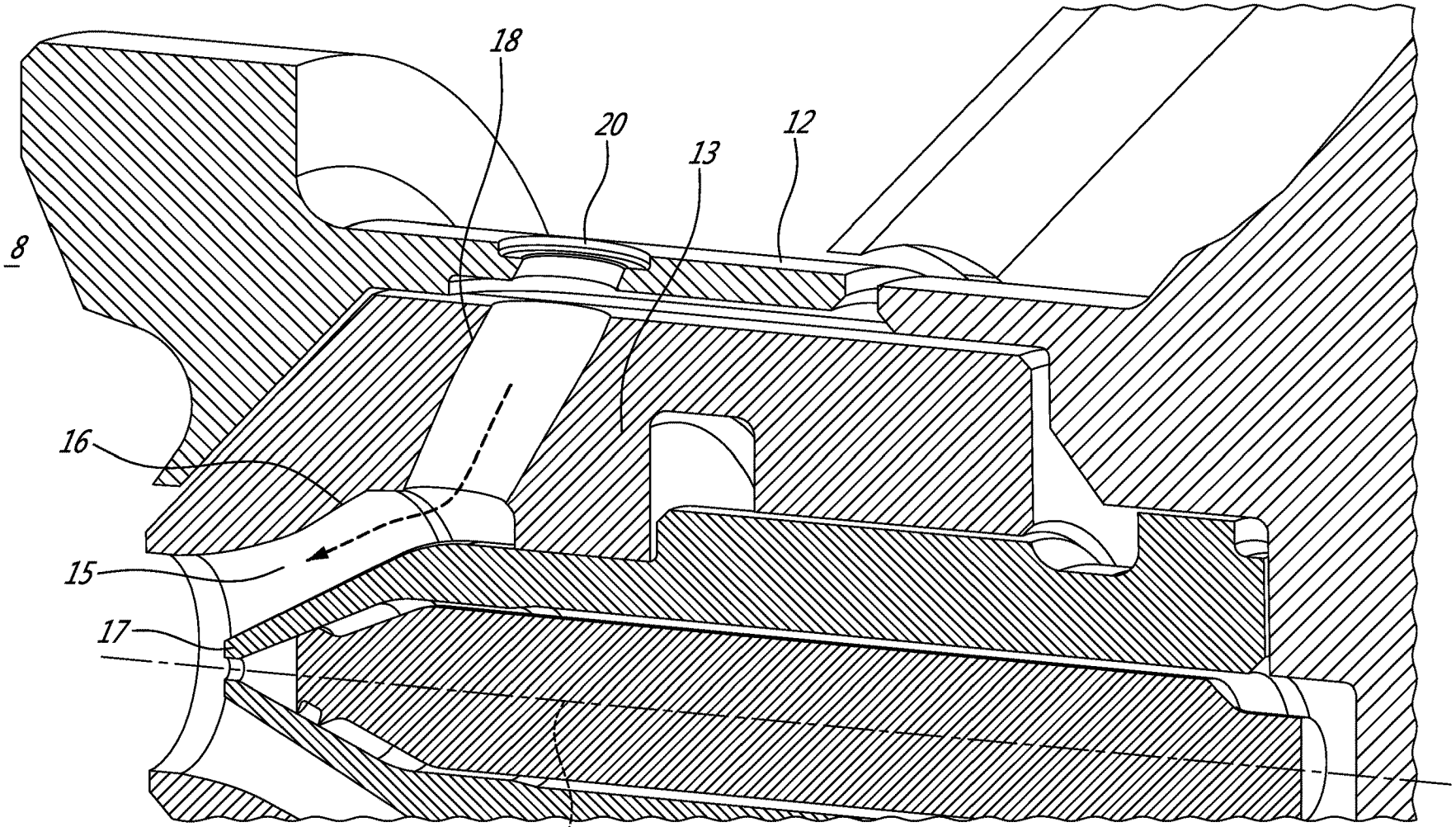
FIG. 2 is a partial axial sectional view through a fuel nozzle in accordance with the present description, however with the thermal insulating sleeve removed, to clearly show a concentric assembly of inner and outer components defining fuel and air flow channels between the components and showing a radially extending air passage bore communicating between the outward surface of the outer component and the inward air flow channel as indicated by a dashed line arrow.

FIG. 2 shows a partial axial section through a fuel nozzle for injecting fuel and air into the combustor 8 of the gas turbine engine. The fuel nozzle has an outer component 12 with an outward surface adapted for exposure to a flow of hot gas within the combustor 8. An inner component 13 is concentrically disposed inside the inward surface of outer component 12 and aligned on a central nozzle axis 14.

The inner component 13 defines an axially extending air flow channel 15. In the example shown an inward facing groove 16 is formed opposite a concentric core component 17 to define the air flow channel 15. The air flow channel 15 can also be formed by other means such as by conventional (casting, machine from solid, etc.) or advanced manufacturing (additive, MIM, chemical etching, etc.) methods. For example the inner component 13 can have an outward surface defining the air flow channel 15 with the inward surface of the outer component 12.

A radial air passage bore 18 extends through the outward surface of the outer component 12 and communicates with the air flow channel 15. An intermediate component may be disposed concentrically between the inner component 13 and the outer component 12. Multiple layers of intermediate components 19 is also possible. The air passage bore 18 passes through the intermediate component(s) as well as the inner component 13 and the outer component 12 to convey air from the air flow channel 15 to the interior of the combustor 8.

As best seen in FIG. 2, an annular recess 20 can be formed in the outward surface of the outer component 12 surrounding the air passage bore 18. The purpose of the annular recess 20 is described below.

Figure 3:
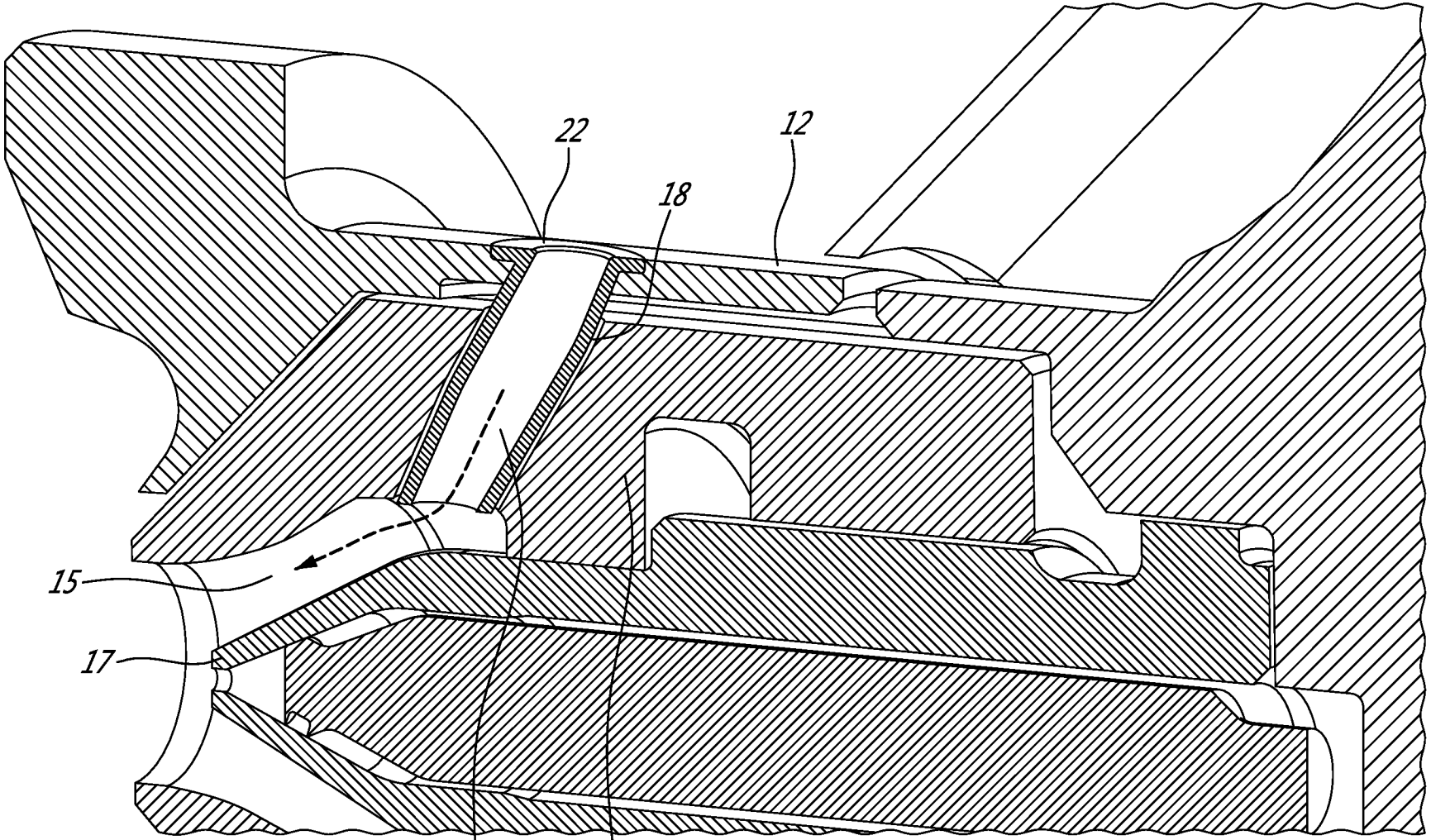
FIG. 3 is a partial axial sectional view like FIG. 2 in accordance with the present description including a thermal insulating sleeve disposed within the radially extending air passage bore.

Referring to FIG. 3, a thermal insulating sleeve 21 is disposed within the air passage bore 18. The sleeve 21 has an outward end with an annular flange 22 connected to the outward surface of the outer component 12 and fit within the annular recess 20 (see FIG. 2). The annular flange 22 (see FIG. 3) and annular recess 20 (see FIG. 2) are connected together brazing or welding in a flush configuration to secure the sleeve 21 in position.

Figure 4:
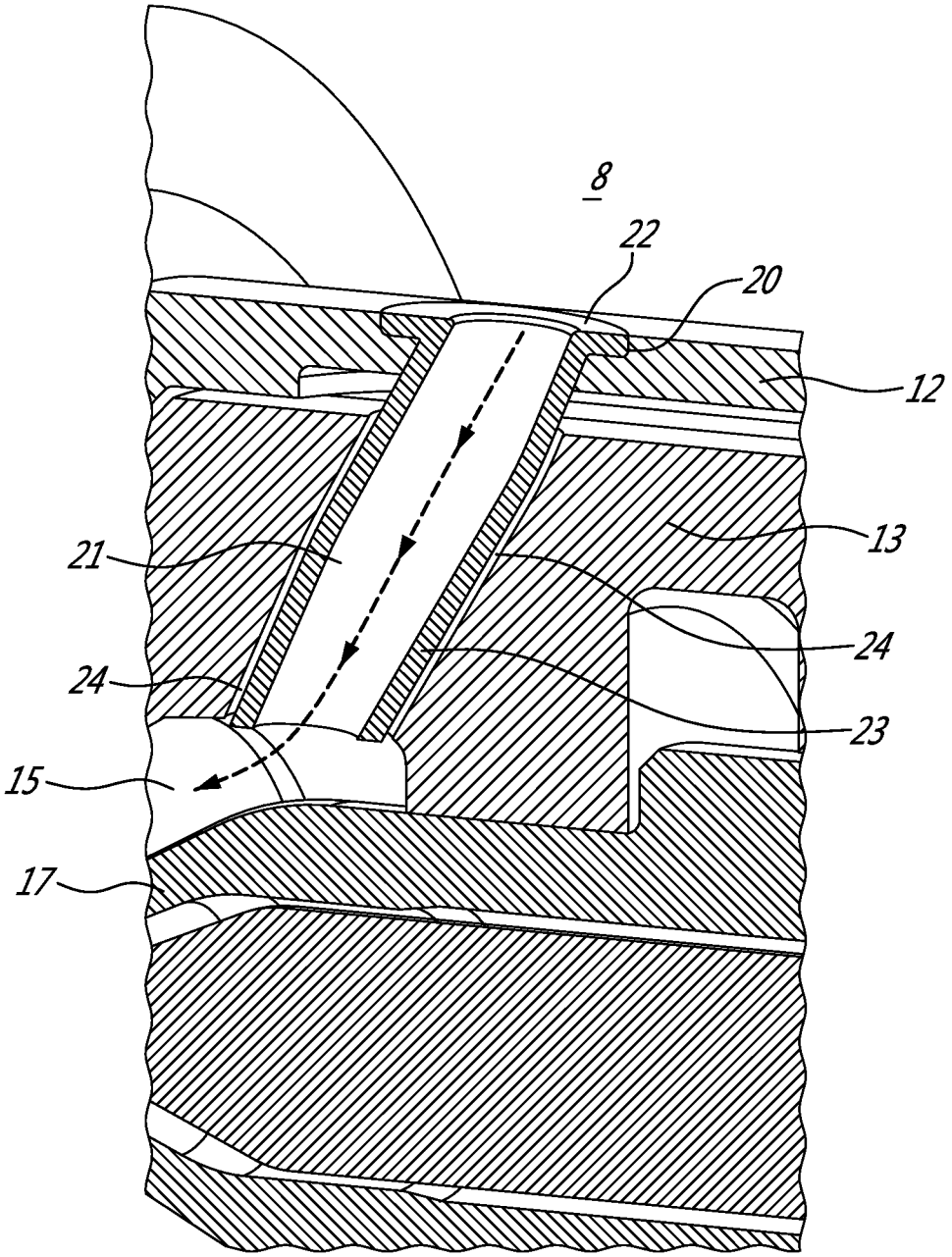
FIG. 4 is a detail sectional view showing the thermal insulating sleeve disposed within the radially extending air passage bore.

Referring to FIG. 4, the sleeve 21 can have a sleeve body 23 spaced apart from the air passage bore 18 in the outer component 12, spaced apart from the inner component 13 and spaced apart from any intermediate component by an annular air gap 24. The annular flange 22 of the sleeve 21 in the example shown is the only portion of the sleeve 21 that is in contact with the outer component 12 and is exposed to hot gas within the combustor 8. The annular flange 22 is mounted flush to the outward surface of the outer component 12 within the annular recess 20 (see FIG. 2) to reduce gas flow turbulence. The sleeve body 23 does not physically contact the inner component 13, and the air gap 24 surrounding the sleeve body 23 insulates the adjacent surfaces of the inner component 13 from convective heat transfer.

The air gap 24 can be in the range of 0.003 inches to 0.010 inches (0.076 mm to 0.254 mm). The concentric core component 17 is inward of the inner component 13. The air passage bore 18 and sleeve 21 extend through the inner component 13 but not through the core component 17. If any intermediate component is provided between outer component 12 and inner component 13, the intermediate component may be spaced apart from the thermal insulating sleeve 21 by the air gap 24. Alternatively, if the sleeve body 23 requires further structural support (other than the connection of the annular flange 22) further discrete points of connection between the sleeve body 23 and the intermediate component or the inner component 13 can be provided by brazing.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A fuel nozzle for injecting fuel and air into a combustor of a gas turbine engine, the fuel nozzle comprising:

an outer component having an outward surface adapted for exposure to a how of hot gas within the combustor;

an inner component concentrically disposed within the outer component, the inner component defining an axially extending air flow channel;

an air passage bore extending from an inlet in the combustor on the outward surface of the outer component to an outlet in the air flow channel; and a sleeve disposed at least within a portion of the air passage bore, the sleeve having a sleeve body spaced apart from the outer component by an air gap.

2. The fuel nozzle according to claim 1 wherein the sleeve has an annular flange connected to the outer component.

3. The fuel nozzle according to claim 2 wherein the annular flange is mounted within an annular recess, in the outward surface of the outer component, surrounding the air passage bore.

4. The fuel nozzle according to claim 3 wherein the annular flange and annular recess are connected together by one of: brazing; welding, press fitted, or made in one piece by additive manufacturing and metal injection moulding.

5. The fuel nozzle according to claim 1 wherein the air gap is within the range of 0.003 inches to 0.010 inches (0.076 mm to 0.254 mm).

6. The fuel nozzle according to claim 1 wherein the inner component has an outward surface defining the air flow channel with the inward surface of the outer component.

7. The fuel nozzle according to claim 1 comprising an intermediate component disposed concentrically between the inner component and the outer component, wherein the air passage bore and the sleeve extend through the intermediate component and wherein the intermediate component is spaced apart from the sleeve by the air gap.

8. A combustor for a gas turbine engine, comprising:

a combustor having a shell defining a combustion chamber;

a fuel nozzle for injecting fuel and air into the combustion chamber, the fuel nozzle compri sing:

an outer component having an outward surface adapted for exposure to a flow of hot gas within the combustor, and an inward surface;

an inner component concentrically disposed within the inward surface of outer component along a nozzle axis, the inner component defining an axially extending air flow channel;

an air passage bore extending from an inlet in the combustor on the outward surface of the outer component to an outlet in the air flow channel; and a sleeve disposed within the air passage bore, the sleeve having a sleeve body spaced apart from the outer component by an air gap.

9. The combustor according to claim 8 wherein the sleeve has an annular flange.

10. The combustor according to claim 9 wherein the annular flange is mounted within an annular recess, in the outward surface of the outer component, surrounding the air passage bore.

11. The combustor according to claim 10 wherein the annular flange and annular recess are connected together by one of: brazing; and welding.

12. The combustor according to claim 8 wherein the air gap is within the range of 0.003 inches to 0.010 inches (0.076 mm to 0.254 mm).

13. The combustor according to claim 8 wherein the inner component has an outward surface defining the air flow channel with the inward surface of the outer component.

14. The combustor according to claim 8 comprising at least one intermediate component disposed concentrically between the inner component and the outer component, wherein the air passage bore and the sleeve extend through the at least one intermediate component.

15. The combustor according to claim 14, wherein the intermediate component is spaced apart from the sleeve by the air gap.

16. A method of thermally protecting a fuel nozzle of a gas turbine engine combustor, the fuel nozzle comprising:

an outer component having an outward surface adapted for exposure to a fow of hot gas within the combustor;

an inner component concentrically disposed within the outer component, the inner component defining an axially extending inner air flow channel;

an air passage bore extending from an inlet in the combustor on the outward surface of the outer component to an outlet in the inner air flow channel;

a sleeve disposed at least within a portion of the air passage bore; and the method comprising: mounting the sleeve in the air passage bore, the sleeve having a sleeve body spaced-apart from the outer component by an air gap.

17. The method of claim 16, comprising connecting the sleeve body at location along a length thereof to the outer component of the fuel nozzle.

18. The method of claim 17, comprising locally welding or brazing the sleeve body to the outer component of the fuel nozzle.

19. The method of claim 18, comprising engaging an annular flange on the sleeve body in a corresponding seat defined in the outer component of the fuel nozzle.

* * * * *